US005661879A

United States Patent [19]

Kelly

[11] Patent Number: 5,661,879

[45] Date of Patent: Sep. 2, 1997

[54] CREMATION BOX AND SYSTEM

[76] Inventor: Dean A. Kelly, 3300 Montura Dr., Bonita Springs, Fla. 33923

[21] Appl. No.: 489,169

[22] Filed: Jun. 9, 1995

[51] Int. Cl.[6] ..... A61G 17/00

[52] U.S. Cl. ..... 27/2; 27/4; 229/167

[58] Field of Search ..... 229/165, 167, 229/176; 27/1, 2, 3, 4, 10

[56] References Cited

U.S. PATENT DOCUMENTS

| | | | |
|---|---|---|---|
| 604,334 | 5/1898 | Myers | 27/4 |
| 2,573,706 | 11/1951 | Grant | 229/167 X |
| 2,588,232 | 3/1952 | Grant | 229/167 X |
| 3,574,906 | 4/1971 | Rittenhouse | 27/4 |
| 4,123,831 | 11/1978 | Covington | 27/4 X |
| 4,135,279 | 1/1979 | Covington | 27/4 |
| 4,151,630 | 5/1979 | Havey | 27/4 X |
| 4,156,956 | 6/1979 | Partridge et al. | 27/4 |
| 5,029,709 | 7/1991 | Faulstick | 229/167 X |
| 5,353,484 | 10/1994 | Woedl et al. | 27/4 |

*Primary Examiner*—Carl D. Friedman
*Assistant Examiner*—Beth A. Aubrey
*Attorney, Agent, or Firm*—Randall J. Knuth

[57] ABSTRACT

The invention is directed to a cremation box for a body, the box including a bottom panel and four side panels engaging the bottom panel to form the sides of the box. At least one side panel is foldable into substantially coplanar relationship with the bottom panel to open a side of the box so that a body may be placed into the box from the side.

1 Claim, 5 Drawing Sheets

CREMATION BOX AND SYSTEM

BACKGROUND OF THE INVENTION

1. Field of the Invention

The present invention relates to a corrugated fiberboard container for holding a body in preparation for cremation.

2. Description of the Related Art

Corrugated fiberboard containers such as boxes have been proposed for use and holding deceased human beings. The strength versus weight characteristics of corrugated paper, along with the ease of their incineration makes such material favorable for use in the cremation art.

Prior cremation boxes have been formed or assembled in a box shape prior to placing the deceased human in the box. These boxes all required a separate plywood or particle board bottom panel stiffener. The problem that confronts technicians is the necessity of lifting the body which might be quite heavy into the box. This type of action places great stress on the technicians' backs.

Additionally, storage facilities for dead bodies, such as morgues, typically have the body laying on a narrow rack extendable into a refrigerated area. The particular location of any body may be too high or too low during loading of the cremation box, thereby increasing strain on the technicians.

SUMMARY OF THE INVENTION

According to the present invention there is provided a corrugated cremation box which can be readily fabricated from single, double, or triple thickness corrugated fiberboard, or any other type of sheet-like material. The cremation box includes four side panels and a bottom panel connected together with at least one side panel that will fold down into coplanar relationship with the bottom panel, whereby a body may be slid into the box from the side as opposed to being lifted into the box.

The open top, parallelepided container of the present invention is formed from a unitary blank that is folded together into an assembled cremation box without the use of staples or separate bottom panel stiffener.

An advantage of the present invention is of forming a compact container for holding a body prior to cremation. Additionally, the cremation box is sanitary in that the boxes are never re-used and are incinerated with the body.

Another advantage of the present invention is that it is easy to load the cremation box through the downwardly folded box side. In the present case, technicians do not have to lift the body as high, and can even slide the body into the box or alternatively slide the box about the body.

Yet a further advantage of the present invention is that of the die cut hand holds utilized to assemble the cremation box without the use of staples. Residue of the box system during cremation is thereby reduced.

A further advantage of the present invention is that the cremation boxes may be shipped and stored in a folded condition thereby minimizing their size until use. Additionally, multiple sets of the cremation boxes may be shipped together for convenient use.

The invention, in one form thereof, provides a cremation box comprising a bottom panel and four side panels connected to the bottom panel to form the sides of the box. At least one of the side panels of the box is foldable into a substantially coplanar relationship with the bottom panel whereby a body may be slid into the box from the side. The invention includes either a long side panel or a short side panel that opens to increase the ease of loading the cremation box.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
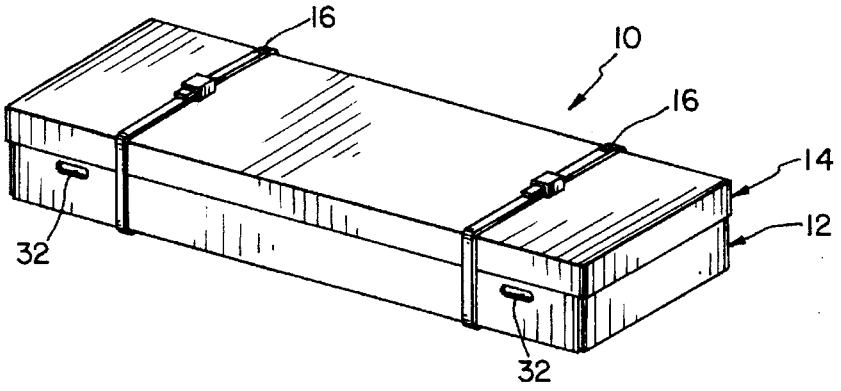
FIG. 1 is a perspective view of the assembled cremation box of one form of the present invention.

Referring now to the drawings and particularly to FIG. 1, there is shown a cremation box 10 according to the preferred embodiment of the invention having a container bottom 12 and a container top 14. Strapping 16 is utilized to tie container bottom 12 and container top 14 together. FIG. 1 illustrates the cremation box 10 in a fully assembled and sealed state.

Figure 4:
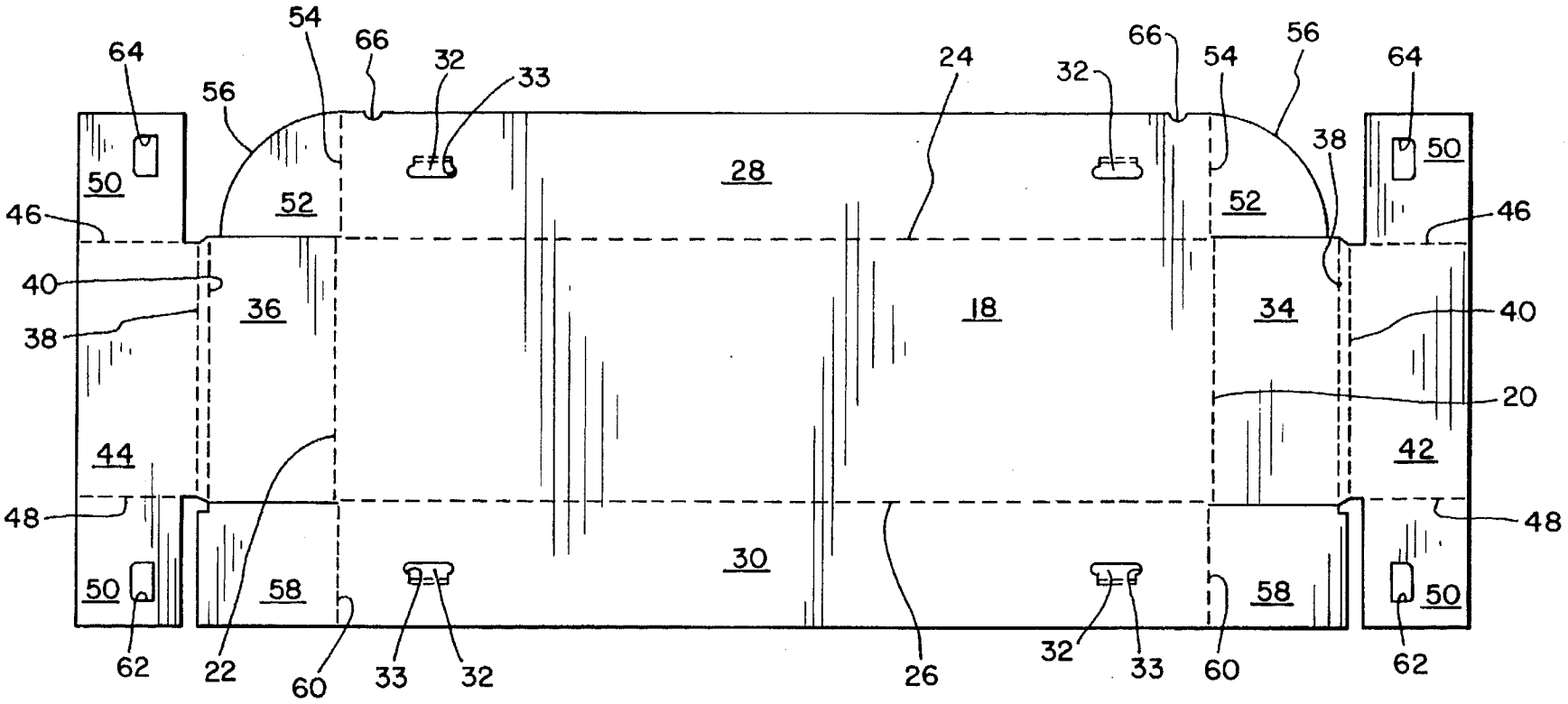
FIG. 4 is a plan view of a blank utilized in forming the sides and bottom of the cremation box depicted in FIGS. 1 through 6.

FIG. 4 illustrates a die cut blank from which container bottom 12 is formed. The blank includes a rectangular panel 18 which forms a horizontally disposed lower most portion of container bottom 12. Rectangular panel 18 is disposed generally centrally within the outline of the blank, which is also generally of rectangular configuration. Rectangular panel 18 is separated from the remaining portions of the blank by fold lines 20 and 22 along the short sides of rectangular panel 18 and by fold lines 24 and 26 along the long sides of the rectangular panel 18. Fold lines 20, 22, 24 and 26 are formed by deforming the blank by scoring, slit scoring, or otherwise as known in the art. By the scoring of the blank along fold lines 24 and 26 there is formed therein first and second long side panels 28 and 30 as shown, each first and second long side panels 28 and 30 include cutouts 32 to form hand holds.

Cutouts 32, die cut from the blank are also utilized to assemble container bottom. Each cutout 32 includes a shoulder 33 so that when a cutout 32 is inserted into slot or opening, shoulder 33 will engage the edge of the slot or opening and thereby prevent removal of cutout 32 from the opening. By utilizing cutouts 32 to lock together portions at container bottom 18. No staples or other fastener need be used. Cutouts 32 remain attached to any at the side panels by fold lines as shown in the drawings.

Fold lines 20 and 22 are similarly scored to define first and second short side panels 34 and 36, respectively. Each short side panel 34 and 36 includes two fold lines 38 and 40 which are separated by a distance substantially the same as the thickness of the blank. Together these fold lines 38 and 40, on each short side panel, define a secondary side panel 42 and 44 respectively which are used to reinforce first and second short side panels 34 and 36. Each secondary side panel 42 and 44 include fold lines 46 and 48 which define reinforcing tabs 50 that reinforce the areas about cutouts 32 on the long side panels. Fold lines 42 and 48 are substantially co-linear with fold lines 24 and 26.

Figure 2:
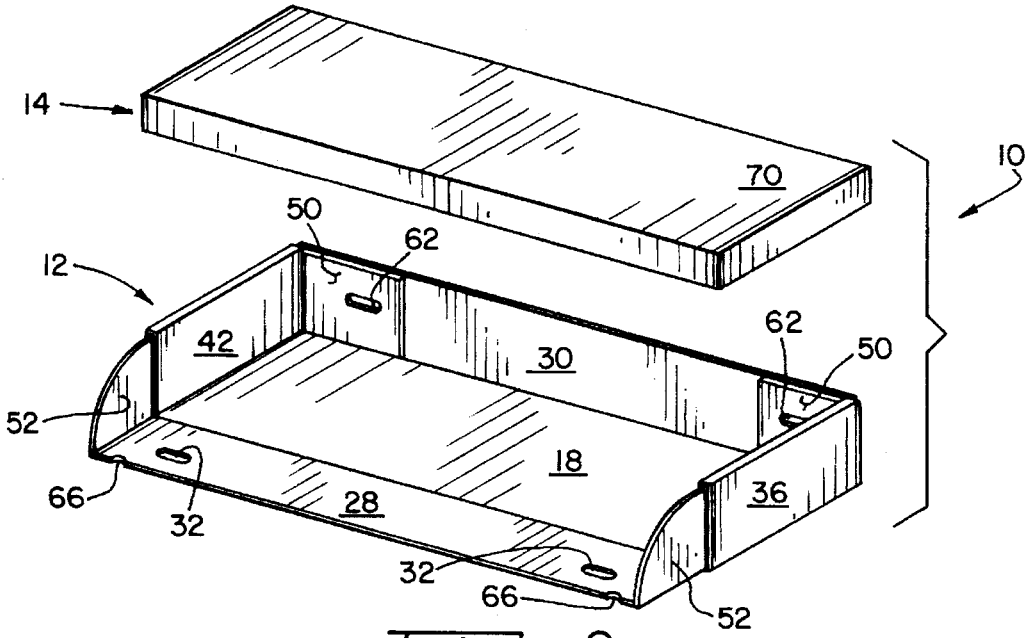
FIG. 2 is an exploded perspective view of FIG. 4 showing a side panel in the open position to permit side insertion of a body into the box.
Figure 3:
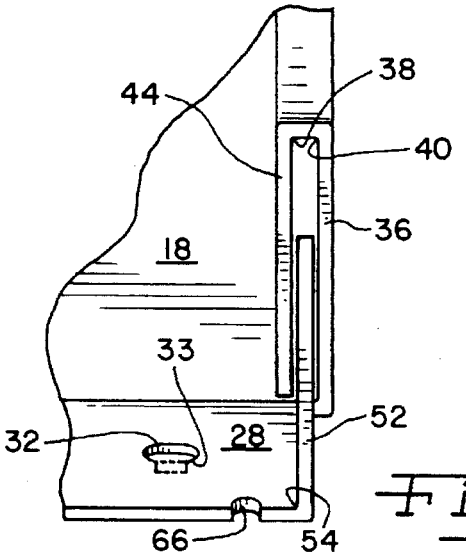
FIG. 3 is an enlarged fragmentary view of the side panel and associated wing panel.

As shown more clearly in FIGS. 2 and 3, a long side panel 28 includes wing tabs 52 connected by fold line 54. As shown in FIG. 4, each wing tab 52 includes a radiused edge 56, in plan view. The operation of wing tab 52 will be more thoroughly discussed below. The opposite long side panel 30 includes panel locking tabs 58 connected by fold lines 60.

Container bottom 12 is formed by first folding locking tabs 58 along fold line 60 upright then folding second long side panel 30 along fold line 26 into an upright position. First and second short side panels 34 and 36 are then folded upright on the outside of locking tabs 58. Then, secondary side panels 42 and 44 are folded along fold lines 38 and 40 down into the inside of the box, thereby locating locking tabs 58 between short side panels 34 and 36 and secondary side panels 42 and 44. Two of the tabs 50, along the side of second long side panel 30 are now flat against the long side panel 30. Hand hold cutouts 32 may now be folded inside the box and inserted into opening 62 in tabs 50. Shoulders 33 on cutouts 32 prevent separation of the now interlocked tab and side panel. The tabs 50 on the opposite side of the box should now be folded to match tabs 50 on the tabs 50 connected to long side panel 30.

The operating side of cremation box tab will now be described. First, the wing tabs 52 will be folded along fold lines 54 into an upright position. These wing tabs 52 are to be inserted into the gap between the first short side panel 34 and secondary side panel 42 and similarly second short side panel 36 and secondary side panel 44. The hand holds 32 should not be pushed inward, inserted and locked into openings 64 in tabs 50 until a body is loaded into container bottom 12. Alternatively, hand holds 32 could be locked into openings 64 to thereby finish construction of container bottom 12.

Long side panel 28 includes one or more thumb notches 66 along an outer edge thereof. These thumb notches 66 permit a technician to easily open side panel 28.

Figure 5:
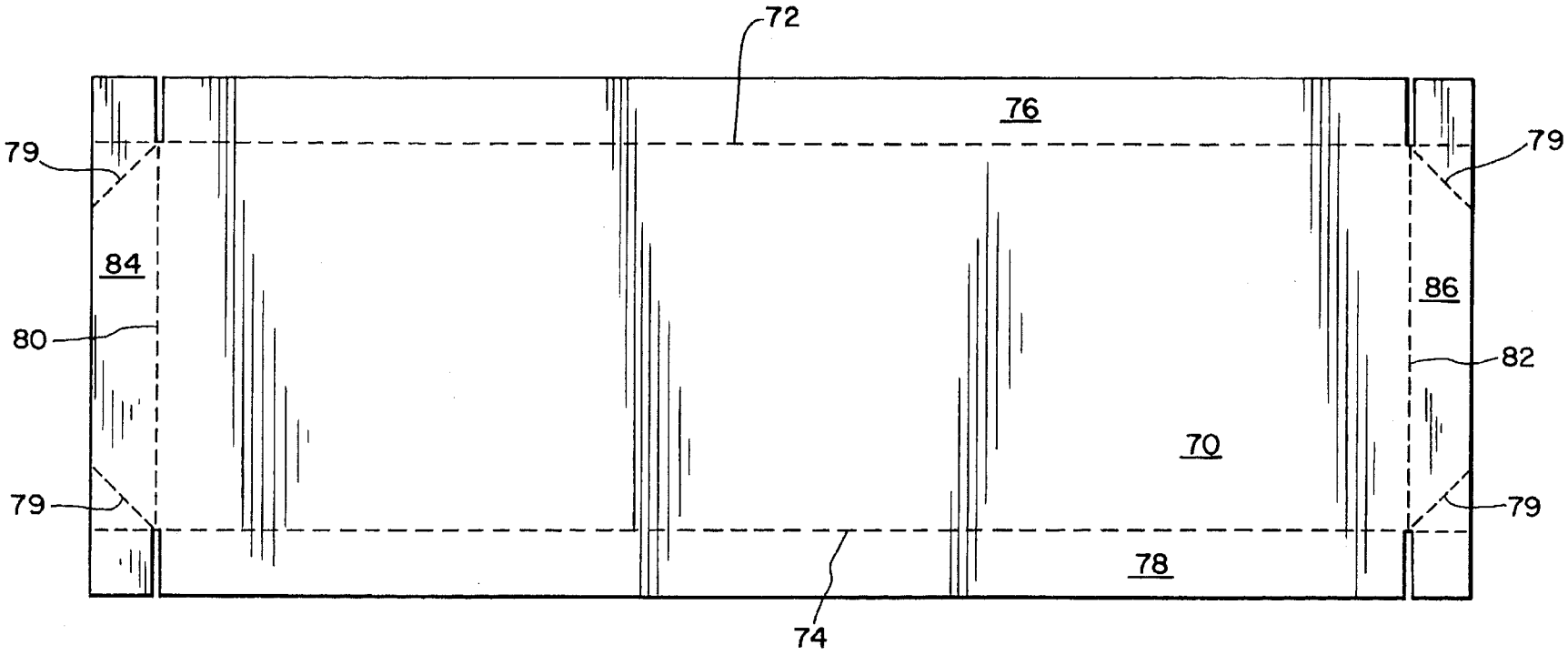
FIG. 5 is a plan view of the blank utilized in forming the box top.

Container top 14 is formed from a die cut blank as shown in FIG. 5, having a rectangular panel 70 disposed generally centrally within the outline of the blank and separated from the remaining portion of the blank by fold lines 72 and 74 running along sides of rectangular panel 70 thereby forming first and second top side panels 76 and 78, respectively. The blank of FIG. 5 also includes fold lines 80 and 82 along the short sides of rectangular box 70 thereby forming top short side panels 84 and 86. To assemble container top 14 from the blank, the blank is folded along fold lines 72, 74, 80 and 82 while the end edges of top short side panels 84 and 86 are glued at the place of manufacture to the top long side panels 76 or 78. Fold lines 79, on container top 14 assist in permitting top 14 to be folded flat for transport. Alternatively other equivalent ways of assembling box top cover may be utilized as known in the art.

The blank, forming container bottom 12 is created from a heavy load-bearing grade of corrugated fiberboard, for example from a heavy single wall corrugated fiberboard or preferably a double wall or triple wall corrugated fiberboard having a bursting strength of approximately five hundred pounds (500 lbs) or greater. Use of the preferred grade of fiberboard eliminates the need for use of any type of additional bottom support, such as plywood or particle board stiffeners. The grade of corrugated fiberboard utilized for container bottom 12 is not necessarily the same as the grade used in container top 14. Container top 14 is normally non-weight bearing, thereby a more inexpensive and less sturdy grade of corrugated fiberboard may be utilized. The container top 14 and bottom 12 are sized to contain a deceased human body.

In operation, cremation box 10 will be substantially formed prior to use as described previously. The feature of loading the body into the box past a foldable side panel is shown in FIG. 2. In the embodiment shown, side panel 28 may be conveniently opened into a coplanar relationship with bottom panel 18 to allow technicians to easily slide a body into container bottom 12. Operators open long side panel 28 by inserting their thumb into thumb notch 33, grabbing long side panel 28, and pulling it open. As panel 28 opens, wing tabs 52 will slide out of the space between the short side panels and their respective secondary side panels. The deceased body will be placed in a plastic body bag 90 and then inserted or located into box 10. After the body is inserted into the box, the technicians will refold side panel 28 into transverse relationship with rectangular bottom panel 18. After long side panels 28 is in its upright position, the technicians will push cutout hand holds 32 into locking engagement through openings 64 in tabs 50, to thereby lock side panel 28 in its upright position. At this time, the box container top 14 is interfit down over container bottom 12, thereby closing cremation box 10. Strapping 16 may then be utilized to ensure that container top 14 does not become removed from container bottom 12 prior to cremation of the total assembly.

Figure 6:
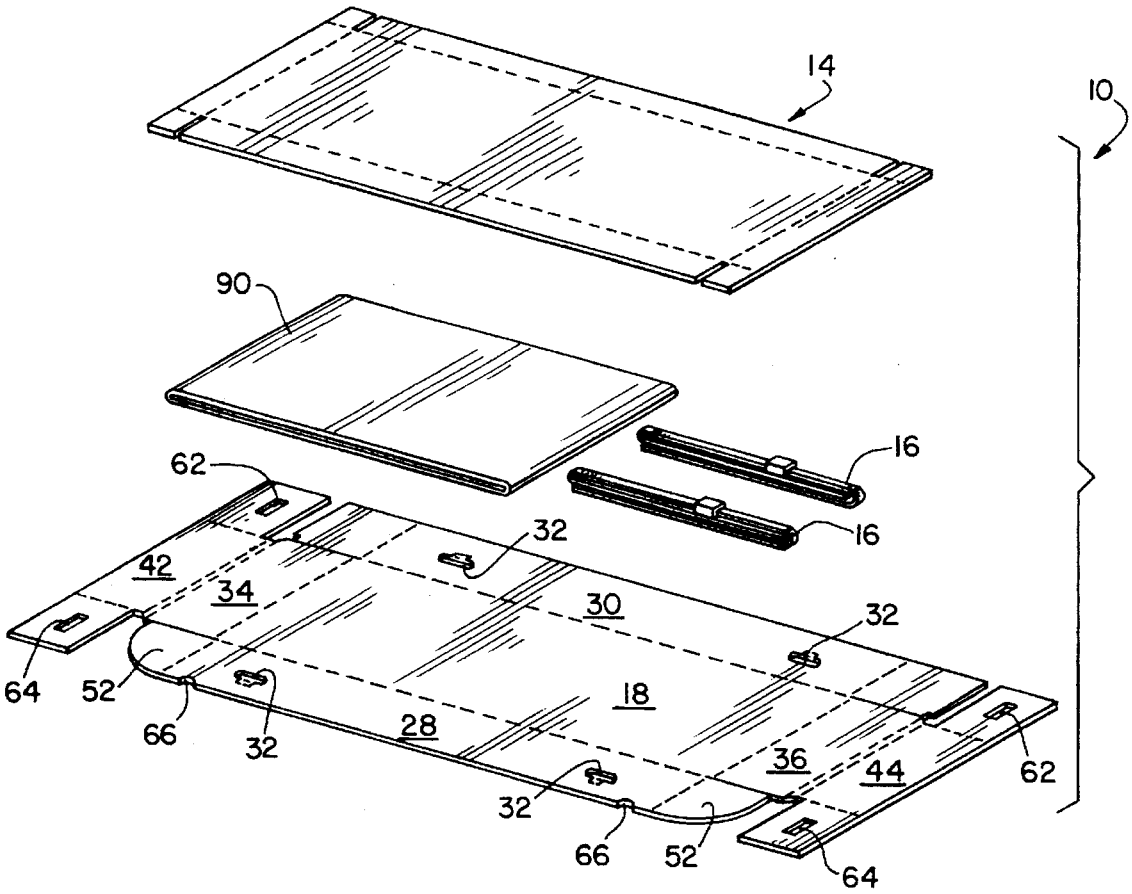
FIG. 6 is an exploded view of the crematory box system included associated items for use.
Figure 7:
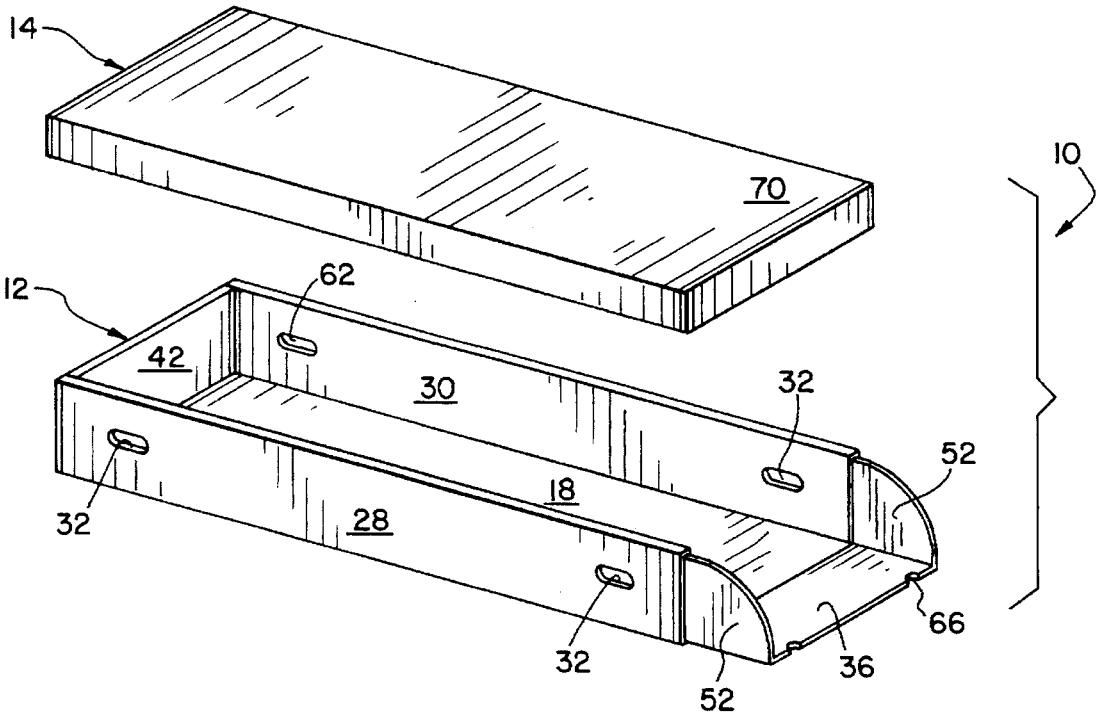
FIG. 7 is an exploded perspective view of an alternate embodiment in which the foldable panel is the short side of the box.

FIG. 6 shows an embodiment of a method of shipping the cremation box and associated portions which include a body bag 90, preferably made of 1.25 mil polyethylene along with two, one-half inch polystrip straps 16. These items are disposed between the blank for container top 14 and the blank for container bottom 12. The entire assembly is shown in FIG. 6 is shipped flat and may be combined with a plurality of other like cremation box packages to form a convenient multi-pack kit.

An alternative and equivalent embodiment envisioned is that of an altered geometry where the first long side panel 28 is not necessarily the side that opens. Other constructions including one having the short sides, such as side panels 34 or 38, constructed in a similar fashion as long side panel 28, to permit opening of the box from the narrow side. This may be advantageous for loading cremation box 10 with bodies stacked in a morgue in which access is more easily obtained along the longitudinal axis of the body, e.g. from head to toe. In this case, the technicians may simply slide the container bottom 12 beneath the body on the morgue slab thereby eliminating the necessity of lifting the body.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of loading a cremation box comprising:

providing a cremation box having a side panel that is foldable into substantially coplanar relationship with the box bottom panel;

folding said side panel down to permit access to the interior of the box through a side;

locating a body into the interior of the box by passing the body through the open side of the box adjacent the folding side panel; and reverse folding the side panel to reform the cremation box back into a complete box form.

* * * * *